US007115177B2

(12) United States Patent
Appel et al.

(10) Patent No.: US 7,115,177 B2
(45) Date of Patent: Oct. 3, 2006

(54) METHOD FOR THE TREATMENT OF METALLIC MATERIALS

(75) Inventors: Fritz Appel, Geasthacht (DE); Stephen Eggert, Lauenburg (DE); Uwe Lorenz, Bardowick (DE); Michael Oehring, Gaesthacht (DE)

(73) Assignee: Gkss-Forschungszentrum Geesthacht GmbH, Geesthacht (DE)

( * ) Notice: Subject to any disclaimer, the term of this patent is extended or adjusted under 35 U.S.C. 154(b) by 18 days.

(21) Appl. No.: 10/021,684

(22) Filed: Dec. 11, 2001

(65) Prior Publication Data

US 2002/0157740 A1 Oct. 31, 2002

(30) Foreign Application Priority Data

Dec. 14, 2000 (DE) ..... 100 62 310

(51) Int. Cl.
*C21D 8/00* (2006.01)
*C22F 1/00* (2006.01)

(52) U.S. Cl. ..... 148/639; 148/640; 148/643; 148/670; 148/671

(58) Field of Classification Search ..... 148/639, 148/640, 643, 670, 671
See application file for complete search history.

(56) References Cited

U.S. PATENT DOCUMENTS 5,262,123 A * 11/1993 Thomas et al. ..... 419/67

FOREIGN PATENT DOCUMENTS

JP 03285757 * 12/1991

* cited by examiner

*Primary Examiner*—Sikyin Ip
(74) *Attorney, Agent, or Firm*—Marshall, Gerstein & Borun LLP

(57) ABSTRACT

In a method for the treatment of metallic materials especially for the consolidation of the texture of the materials, a blank of the metallic material is heated to a transformation temperature and the blank is then subjected to twisting preferably while, at the same time, being compressed. In this way, the texture can be refined to a large degree in a simple and inexpensive manner.

20 Claims, 4 Drawing Sheets

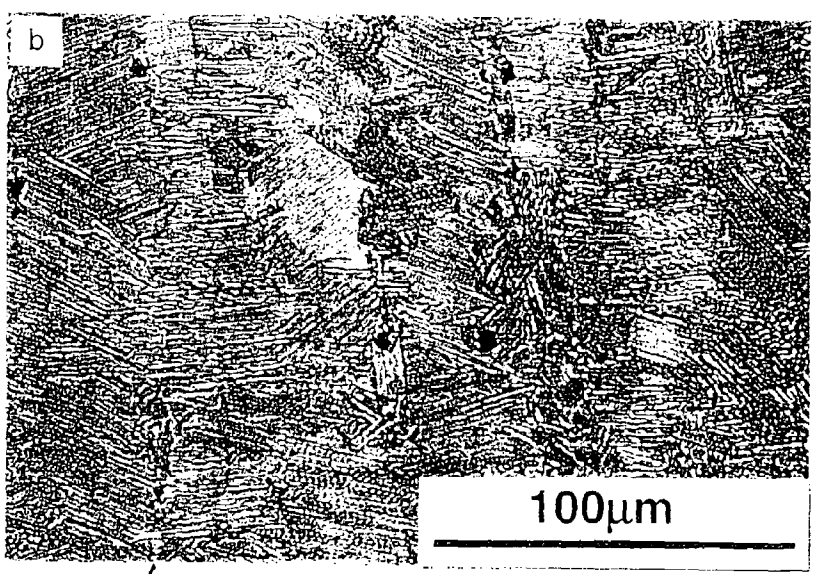
Fig. 3b
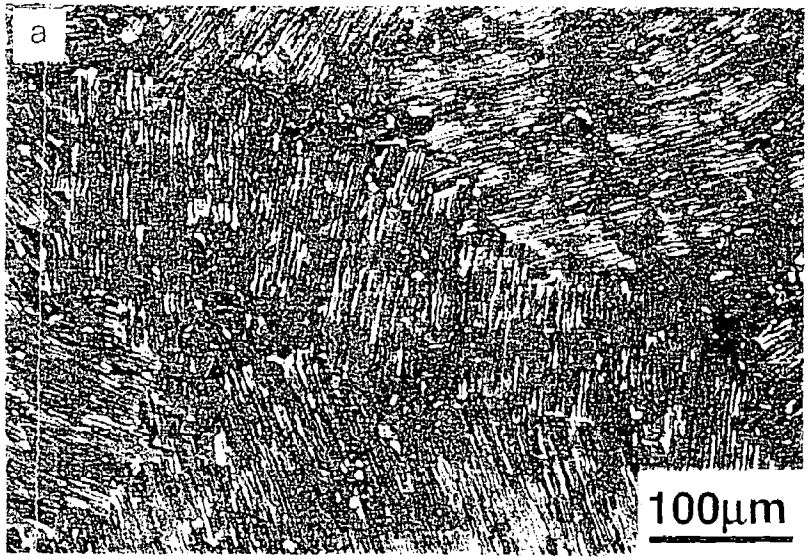
Fig. 3a
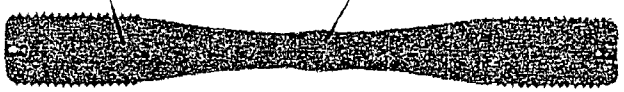

METHOD FOR THE TREATMENT OF METALLIC MATERIALS

BACKGROUND OF THE INVENTION

The invention relates to a method for the treatment of metallic materials, particularly for the consolidation of the structure or texture of metallic materials as well as metallic blanks.

Conventional treatment or respectively, reformation techniques for metallic materials provide for consolidation results, which generally are not totally satisfactory. Special metallic materials for example of the group of titanium aluminides or magnesium materials have, after the conventional treatment or transformation techniques such as forging or extrusion pressing, substantial chemical and structural inhomogeneities in their texture, which cannot be tolerated for certain technical applications. With the known treatment or, respectively, transformation techniques only relatively low transformation degrees can be achieved. This is not acceptable if the metallic materials are to be used for example in thermically and mechanically highly stressed areas for example for turbine blades of jet engines for airplanes or connecting rods for automobile engines.

Metallic materials such as inter-metallic titanium aluminides are very brittle and therefore hard to transform. In the past, such metallic materials were manufactured exclusively by melt metallurgical processes, mainly by vacuum arc melting, plasma melting and induction melting. Although the molten material is usually melted two or three times, the cast bodies still have substantial quality deficiencies, mainly coarse grain textures with certain preferred orientations of the crystals, large local variations in the composition and the occurrence of pores. Such deficiencies occur not only with the primary casting for example of titanium aluminides but also with many other metallic materials so that they are not suitable—as already mentioned—for the direct manufacture of components from the castings. The material, which is present as primary casting, must therefore be consolidated structurally and chemically. To this end, high temperature transformation by forging or extrusion pressing is generally used mainly for obtaining a fine-grain texture and a homogenization, that is, a reduction of the local variations of the material composition for example in metallic alloys.

In the past, the texture of the castings was consolidated by re-crystallization procedures and phase conversions, which were initiated by an input of mechanical energy into the material during the high-temperature transformation. The fineness and homogeneity of the material texture after transformation depends on the transformation temperature and the transformation velocity and to a large degree also on the transformation degree that is on the extent of the plastic deformation achieved during the transformation of the material. This transformation degree is limited with conventional one-step forging by compression generally to 90 to 95%. With such transformation degrees, high secondary tensions occur at the periphery of the forged body which often result in the formation of cracks. This is particularly critical with brittle materials such as titanium aluminides. These materials are therefore generally transformed to a much lesser degree. Higher degrees of transformation require multi-step forging which is expensive and time-consuming and is not usable for all desired component shapes.

It is also disadvantageous that no suitable die materials are available for forging at temperatures above 1000° C. The dies of molybdenum alloys used so far at temperatures up to 1000° C. can only be operated under a protective gas cover, which makes the forging a difficult task.

With the extrusion pressing, which has also been used for the transformation, substantially higher degrees of transformation can be achieved than with forging. With a superimposed hydrostatic compression also brittle materials can be transformed relatively well. In practical applications however, the transformation degree achieved by extrusion pressing is generally limited by the geometry of the desired body to a reduction in cross-section by about 10:1. It is also a disadvantage that substantially higher temperatures are required for the extrusion pressing than for the forging. Materials like titanium aluminides, which are subject to oxidation and corrosion must therefore be encapsulated for the extrusion pressing, which is complicated and expensive.

It is the object of the present invention to provide a method for the treatment of metallic materials which provides for a much improved consolidation of the texture and which is also applicable for very brittle materials, which has, so far, been difficult to transform such as inter-metallic alloys.

SUMMARY OF THE INVENTION

In a method for the treatment of metallic materials, especially for the consolidation of the texture of the materials, a blank of the metallic material is heated to a transformation temperature and the blank is then subjected to twisting preferably while being compressed at the same time. In this way, the texture can be refined to a large degree in a simple and inexpensive manner.

A blank in the sense of the above description is an unfinished body of a metallic material, which has been treated for example by multiple melting and by extrusion pressing or forging. For scientific purposes, the metallic element may be a sample but it may also be an unfinished product from which an end product is to be made such as turbine blades for jet engines or connecting rods for engines of motor vehicles.

With the solution according to the invention, blanks of metallic materials can be produced with a desirable substantially improved texture consolidation of the metallic material. The utilization of the method according to the invention for brittle materials, which are difficult to transform, has yielded results with respect to the texture achieved with the method, which have substantially exceeded the expectations. The structural and chemical consolidation of the texture was greatly improved as compared to that achieved with the known forging and extrusion pressing methods. Another substantial advantage of the method according to the invention resides in the fact that the transformation temperature to which the unfinished element is to be heated is substantially below the temperature needed for the forging and extrusion pressing procedures used so far.

Preferably, the deformation process according to the invention is performed by twisting the metal body. The twisting of the metal body or blank in itself provides for an internal plastic deformation. The twist angle is not subject to any geometrical limitations so that a high plastic deformation of the body can be achieved by multiple twisting procedures. With the twisting high transformation ratios can be realized even with small effective lengths of the body, that is high degrees of transformation of the material can be achieved even for materials which are difficult to transform. With the twisting a large amount of mechanical energy is introduced into the material whereby a uniform dynamic re-crystallization of the material structure is initiated.

In order to further improve the texture of the metallic material, the deformation is achieved with a concurrent compression of the blank. As, essentially at the same time, the blank is twisted and also subjected to compression, that is the two deformation procedures are superimposed, any shear cracks developing during the deformation of the metallic material are again closed at a very early stage so that they cannot grow to macro-cracks. With the superimposition of twisting and compression of the body furthermore a more homogeneous deformation of the material is achieved, since the shear processes caused by the two deformation processes are effective at a high inclination angle relative to each other if the blank body has a suitable geometric configuration.

Preferably, the blank is subjected to compression by a constant force. However, it is also possible to control the compression of the blank by maintaining a constant deformation speed.

Basically, the unfinished body can be heated in any appropriate manner. The heating of the blank however should be so controlled that the blank as a whole is heated or maintained at transformation temperature while it is subjected to deformation. In that case, the whole blank is deformed, that is, twisted and/or compressed.

It may however be advantageous to heat the blank in such a way that only a selected part of the blank, that is the part, which is to be deformed, is heated. Then a stepwise deformation of the unfinished body depending on the position of the heating device relative to the blank or the location of the heat input is performed.

The blank is heated preferably by an electric coil which is disposed around the blank and which may be movable along the blank in order to heat selected areas of the blank.

Preferably, the blank is deformed at a temperature of about 1000° C.; however, higher or lower temperatures may be employed as the transformation temperature of the unfinished body depending on the particular metallic material.

If extremely high transformation temperatures above 1000° C. should be needed, it is advisable to perform the procedure at least partially in a cover gas atmosphere.

The invention also relates to a blank of titanium aluminide treated by compression-twisting wherein the titanium aluminide preferably has the composition.

Ti-47 Al-3.7 (Nb, Cr, Mn, Si)-0.5 B

The invention will be described below in greater detail on the basis of a particular embodiment with reference to the accompanying drawings.

BRIEF DESCRIPTION OF THE DRAWINGS

FIG. 2 is a macro-photo of a TiAl sample consisting of Ti-47 Al-3.7 (Nb, Cr, Mn, Si)-0.5 B treated in accordance with the method of the invention, wherein the composition of the sample is given in atomic %, and FIGS. 3*a, b* and *c* are light microscopic photos of the texture for showing the fineness of the texture achieved by the combination of twisting and compression, wherein FIG. 3*a* shows the texture in the transformed top area of the sample; FIG. 3*b* shows the texture in the transformed center area of the sample and FIG. 3*c* shows an electron microscope scanned surface in the center area of the sample showing the refined texture of the sample.

DESCRIPTION OF A PARTICULAR EMBODIMENT

The method described herein has been tested in the laboratory with a TiAl alloy of the composition (in atomic percent):

Ti-47 Al-3.7 (Nb, Cr, Mn, Si)-0.5 B

Figure 1:
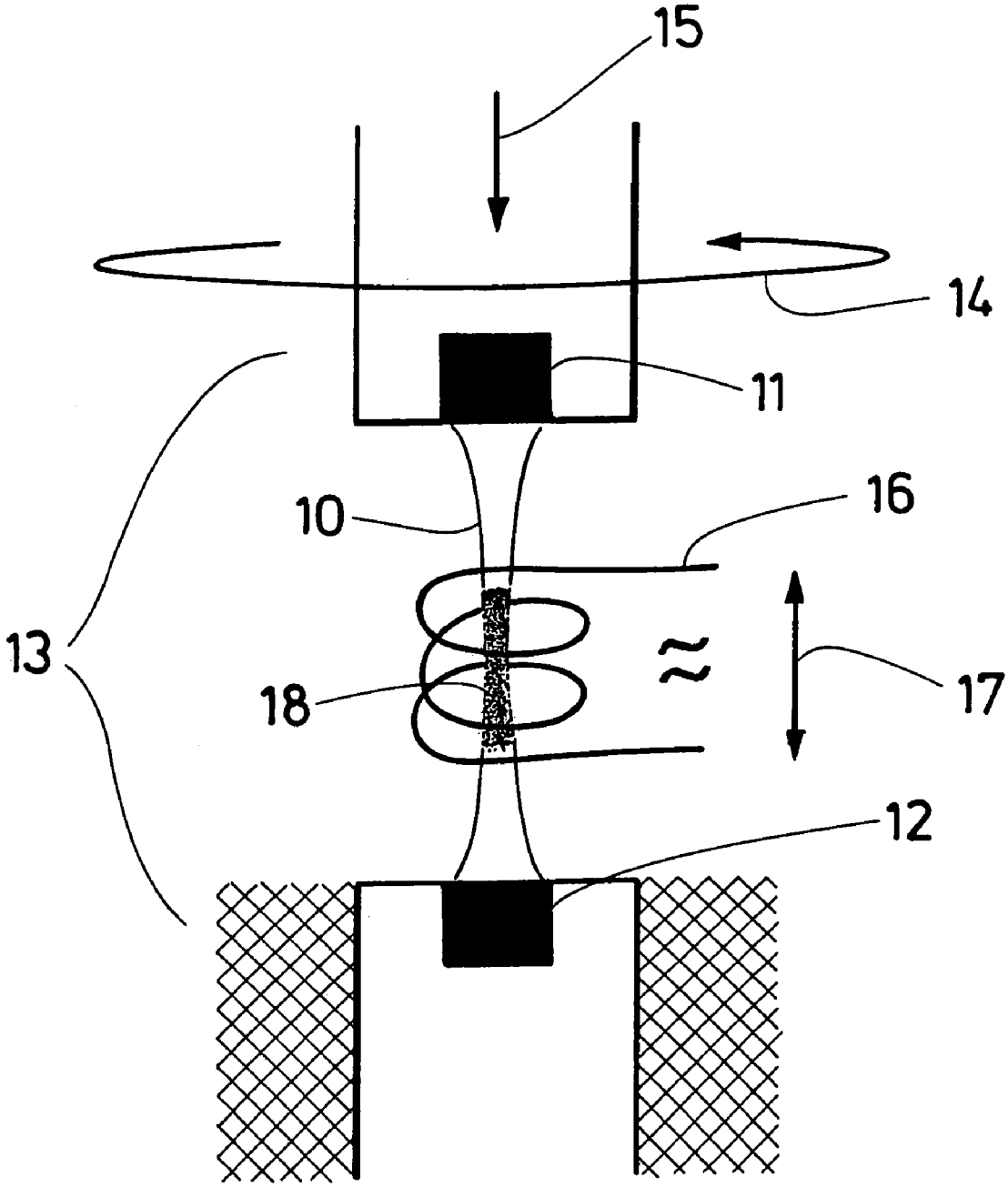
FIG. 1 is a sketch showing in principle a technical solution for the method according to the invention wherein the blank is subjected to a combination of twisting and compression.

The experiments were performed in air. Samples with threaded end portions were installed in a compression apparatus in which the sample engagement structures could be rotated relative to each other for twisting of the sample (FIG. 1). The samples were heated by an induction coil to different transformation temperatures between 1000° C. and 1100° C. the sample temperature was determined by a thermoelement. Because of the geometric design of the induction coil the hot sample zone had a length of about 6 mm, which was considered the effective sample length for the evaluation of the test.

After reaching the desired temperature, first a constant compression force of 10 to 50 Mpa was applied to the samples. During this step, no deformation occurred because of the very coarse casting texture. Then the samples were twisted within one minute by an angle of 720° (two turns). With the given setup of the sample r=4 mm, 1 =6 mm this corresponds at the outer circumference of the sample to the very high deformation degree of about $\gamma_t$=600% and a high stretch rate of $d\gamma_t/dt=5\times10^{-2}s-1$. As a result, an intense re-crystallization takes place during twisting. With the concurrent texture refinement the yield stress of the material drops so that, with the compression forces applied, the sample is also deformed in a compression mode. In this way, the desired combination of twisting and compression is achieved. The compression deformation produced in this way is typically 20%.

Figure 2:
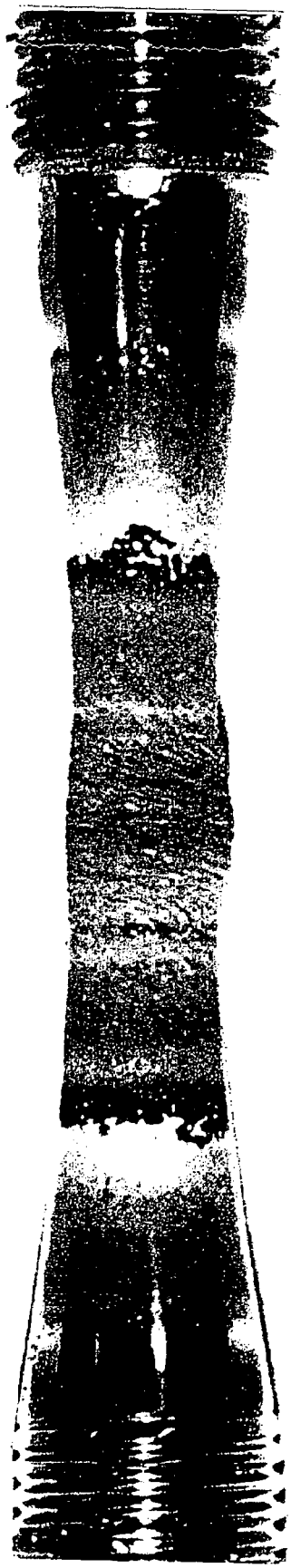
Figure 3C:
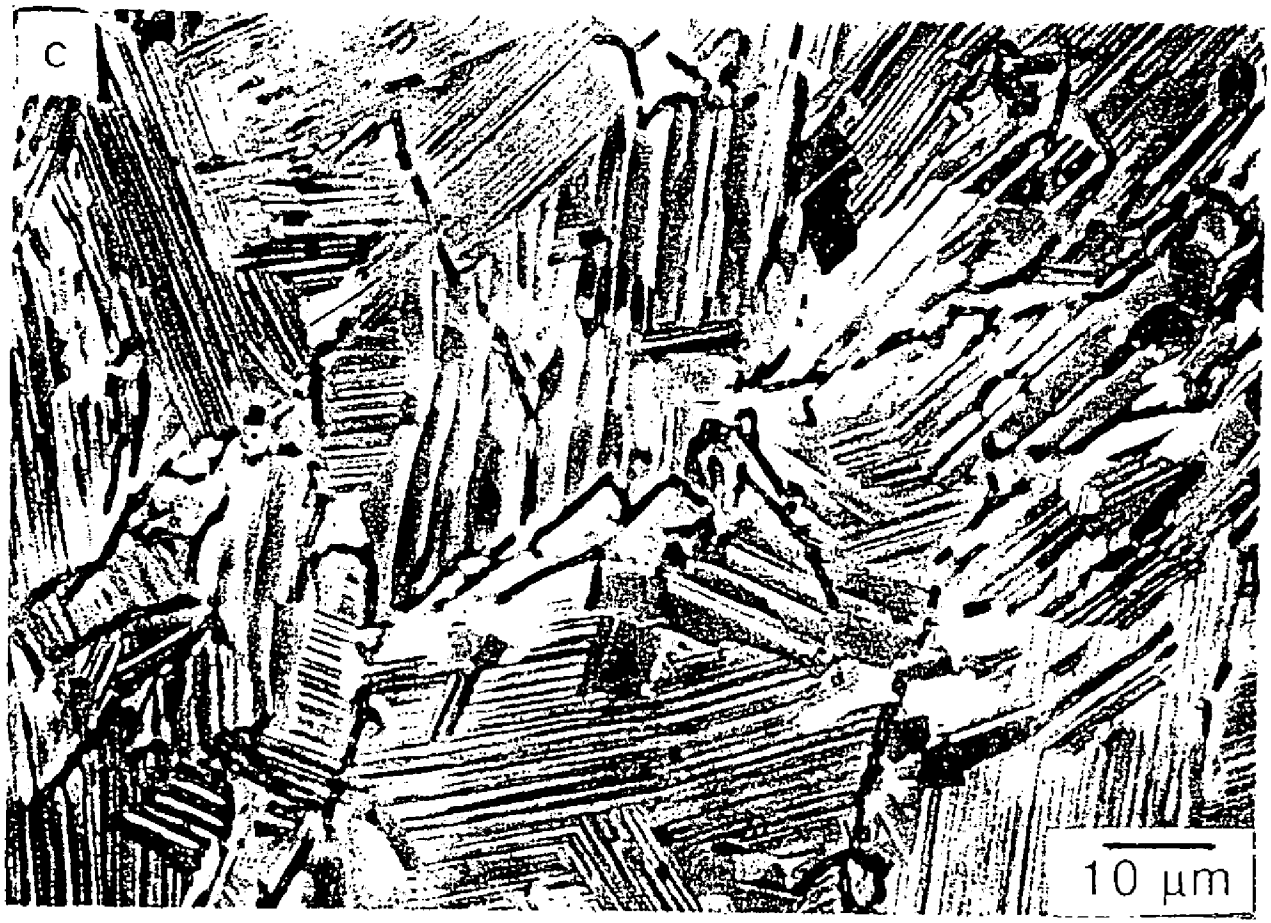

FIG. 2 is an enlarged photo of the transformed sample. The texture refinement achieved by the transformation is demonstrated in FIGS. 3*a*, 3*b* and 3*c* with a light microscopic texture photograph.

FIG. 3*a* shows the relatively coarse casting texture in the end area of the sample which area was not deformed and wherein consequently no re-crystallization took place. In contrast, in the center part of the sample which has been deformed by compression and twisting, the texture was greatly refined (FIG. 3*b*). The average grain size of lamellar colonies in the end area of the sample is about a=800 μm whereas the equivalent size in the center section of the sample is reduced to about d=50 μm. In the sample section, which was transformed by twisting and compression, no cracks occurred inspite of the high transformation degree. The transformation degree could therefore certainly be further increased for additional texture refinement.

The method described herein can easily be expanded to an industrial scope, since the components required herefor such as induction heaters or transformation machines are standard equipment in the metallurgical industry.

It is a particular advantage of the method according to the invention that the sample holder does not need to be heated. It is therefore not subjected to the high temperatures and does not need to consist of highly temperature resistant materials. In the experiment, the sample to be transformed can be heated over its full length to the desired transformation temperature. Alternatively, however, the sample may be heated locally by induction heating. This last mentioned procedure has the advantage that, locally, very high transformation degrees and transformation speeds can be achieved under otherwise the same conditions. This is advantageous for many materials for achieving a homogeneous re-crystallization. For a complete transformation of the sample, the induction coil must be moved along the sample axis as indicated in FIG. 1. As demonstrated by the results of the testing, the transformation can occur in comparison with conventional forging and extrusion pressing procedures at relatively low transformation temperatures of around 1000° C. This greatly simplifies the transformation of corrosion sensitive materials such as titanium aluminides. However, with the method according to the invention, the transformation process can also be performed at extremely high temperatures and under a protective gas cover in a relatively simple manner. With titanium aluminides for example often transformation temperatures of more than 1350° C. are required since at those temperatures special lamellar texture or structure morphologies can be provided. Since the method according to the invention is very variable, the transformation conditions can be adjusted to a large degree to the deformation and re-crystallation behavior of a particular material so that also relatively brittle materials such as titanium aluminides can be transformed relatively easily. The torques and forces required for the transformation however can be applied by sample holders which can be kept relatively cool so that the sample holders do not need to be constructed of expensive high temperature materials.

What is claimed is:

1. A method for the consolidation of the texture of metallic materials, consisting of the steps of:

a) providing a blank of a metallic material, b) heating said blank to a transformation temperature, and c) deforming said blank by twisting said blank about a longitudinal axis thereof and, at the same time, compressing said blank in the direction of said longitudinal axis, where said steps (a) to (c) are carried out by substantially maintaining the form of the blank.

2. A method according to claim 1, wherein during said compression said blank is subjected to a constant force.

3. A method according to claim 1, wherein said compression step is preformed by subjecting said blank to a constant deformation speed.

4. A method according to claim 1, wherein said blank is heated over its full length for the consolidation of the texture thereof.

5. A method according to claim 1, wherein only the area of said blank is heated where the deformation is to be performed.

6. A method according to claim 1, wherein said blank is heated by electrical induction heating.

7. A method according to claim 1, wherein the deformation of said blank is performed at a temperature of about 1000° C.

8. A method according to claim 1, wherein the deformation of said blank is performed at least partially under a protective gas cover.

9. A method according to claim 1, wherein said metallic material is titanium aluminide.

10. A method according to claim 9, wherein the titanium aluminide has the composition, in atomic percent, as follows:

Ti-47A1-3.7(Nb, Cr, Mn, Si)-0.5 B.

11. A method for the consolidation of the texture of metallic materials, consisting of the steps of:

a) providing a blank of a metallic material, b) heating said blank to a transformation temperature, and c) deforming said blank by twisting said blank about a longitudinal axis thereof and, at the same time, compressing said blank in the direction of said longitudinal axis.

12. A method according to claim 11, wherein during said compression said blank is subjected to a constant force.

13. A method according to claim 11, wherein said compression step is preformed by subjecting said blank to a constant deformation speed.

14. A method according to claim 11, wherein said blank is heated over its full length for the consolidation of the texture thereof.

15. A method according to claim 11, wherein only the area of said blank is heated where the deformation is to be performed.

16. A method according to claim 11, wherein said blank is heated by electrical induction heating.

17. A method according to claim 11, wherein the deformation of said blank is performed at a temperature of about 1000° C.

18. A method according to claim 11, wherein the deformation of said blank is performed at least partially under a protective gas cover.

19. A method according to claim 11, wherein said metallic material is titanium aluminide.

20. A method according to claim 19, wherein the titanium aluminide has the composition, in atomic percent, is as follows:

Ti-47A1-3.7(Nb, Cr, Mn, Si)-0.5 B.

* * * * *